US005298053A

United States Patent [19]

Griffing

[11] Patent Number: 5,298,053

[45] Date of Patent: Mar. 29, 1994

[54] CONSUMABLE LANCE FOR OXYGEN INJECTION AND DESULFURIZATION AND METHOD

[75] Inventor: Neal R. Griffing, Bethlehem, Pa.

[73] Assignee: Bethlehem Steel Corporation, Bethlehem, Pa.

[21] Appl. No.: 105,274

[22] Filed: Aug. 12, 1993

[51] Int. Cl.[5] ..... C21C 5/32; C21C 7/064

[52] U.S. Cl. ..... 75/533; 75/537; 266/225

[58] Field of Search ..... 266/225, 226; 75/533, 75/537

[56] References Cited

U.S. PATENT DOCUMENTS

| | | | |
|---|---|---|---|
| 2,577,764 | 12/1951 | Hulme | 75/51 |
| 2,587,573 | 2/1952 | Wyane | 75/51 |
| 2,670,283 | 2/1954 | Soisson | 75/52 |
| 2,715,551 | 8/1955 | Kiernan | 302/55 |
| 2,738,234 | 3/1956 | Anderson | 302/56 |
| 2,806,781 | 9/1957 | Shepherd et al. | 75/53 |
| 2,807,508 | 9/1957 | Bieniosek et al. | 302/57 |
| 2,821,439 | 1/1958 | Spies, Jr. et al. | 302/53 |
| 2,990,272 | 6/1961 | Shaw et al. | 75/55 |
| 3,703,279 | 11/1972 | Saccomano et al. | 266/41 |
| 3,925,061 | 12/1975 | Carlsson et al. | 75/58 |
| 4,373,949 | 2/1983 | Spreull et al. | 75/60 |
| 4,417,924 | 11/1983 | Schwer | 75/257 |
| 4,761,178 | 8/1988 | Griffing et al. | 75/51.2 |
| 4,792,125 | 12/1988 | Hand, Sr. | 266/266 |
| 4,795,491 | 11/1989 | Quigley | 75/257 |
| 4,852,860 | 8/1989 | Griffing et al. | 266/268 |
| 5,028,257 | 7/1991 | Tomkins et al. | 75/305 |
| 5,106,412 | 4/1992 | Bogan et al. | 75/570 |

FOREIGN PATENT DOCUMENTS

| | | | |
|---|---|---|---|
| 2141176 | 2/1973 | Fed. Rep. of Germany | 266/226 |

OTHER PUBLICATIONS

Marpels, et al., Desulfurization of Basic Electric Arc Steel by TC Injection or Powdered Materials Jun. 1960, Journal of the Iron and Steel Institute, pp. 195–201.

Santen, et al., Techniques for Obtaining Extremely Low Contents of Sulfur in Steel under Oxidizing and Reducing Conditions, 1971, pp. 7–16.

Trentini, et al., Desulfurization of Liquid Pig Iron by Blowing with Lime Powder, Journal of the Iron and Steel Institute, Jun. 1956, pp. 124–133.

*Primary Examiner*—Melvyn J. Andrews

[57] ABSTRACT

A consumable lance for simultaneously reheating and desulfurization of a molten metal bath includes an internal circuit for delivering oxygen below the slag metal interface and an external circuit for delivering a desulfurizing agent to the slag metal interface. Improved desulfurization and reheating results are achieved.

24 Claims, 3 Drawing Sheets

Fig. 4
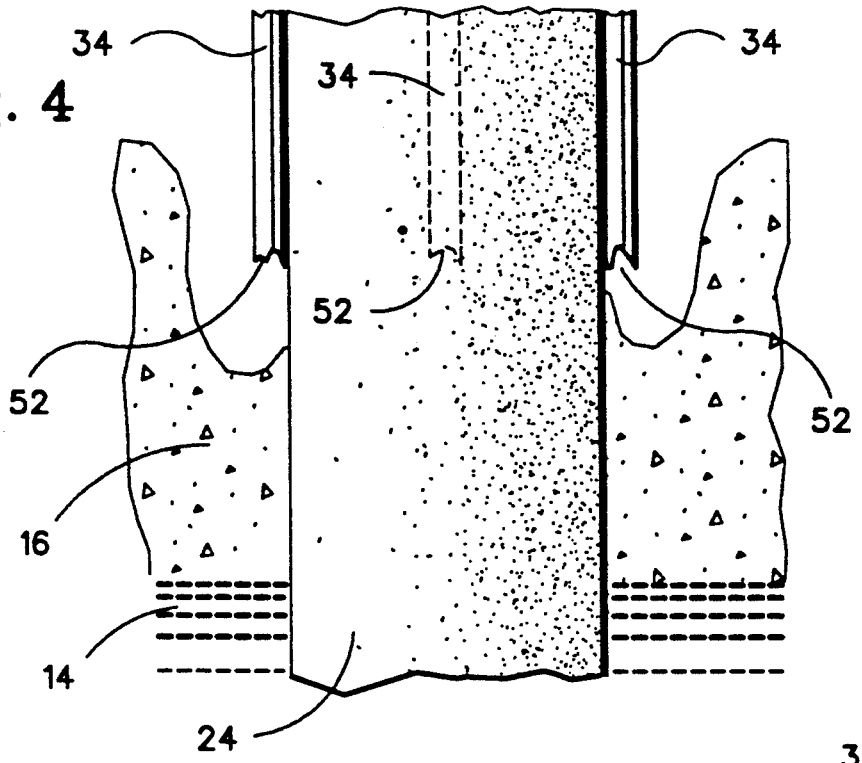
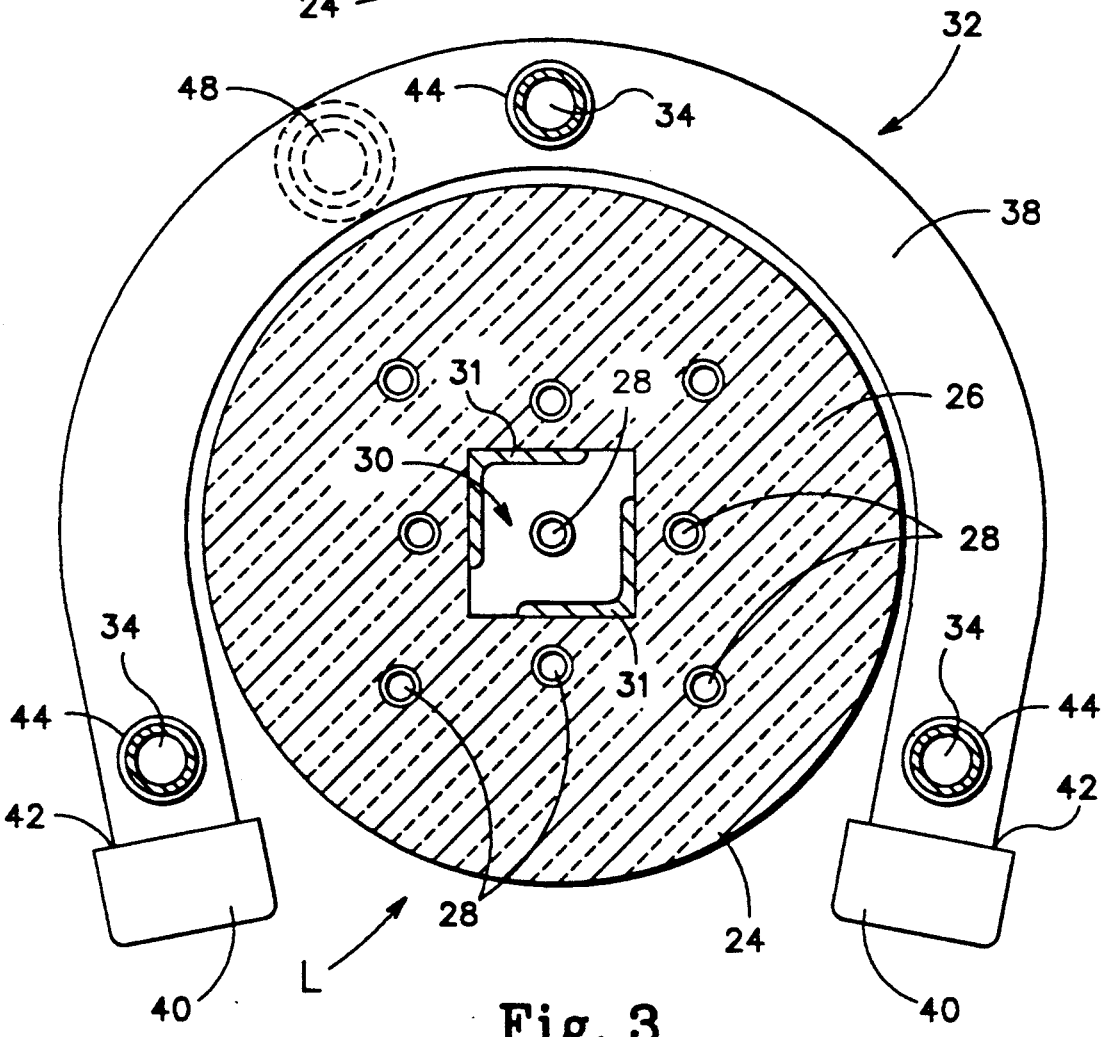
Fig. 3

CONSUMABLE LANCE FOR OXYGEN INJECTION AND DESULFURIZATION AND METHOD

FIELD OF THE INVENTION

The disclosed invention relates to consumable lances for simultaneously introducing oxygen and a desulfurizing agent into a ladle of molten steel, and to a method therefor.

BACKGROUND OF THE INVENTION

Molten steel is produced in large furnaces and may thereafter be transferred into smaller vessels, such as ladles, for further processing. If the molten metal is to be delivered to a continuous caster, then it must be poured into the caster at the proper temperature. During the period between tapping the furnace and supplying the molten metal to the caster, however, the temperature of the steel may fall below the required minimum. The temperature of the molten steel must thus be raised to at least the minimum temperature, otherwise the steel will need to be poured into ingot molds. The temperature of the steel in the ladle can be raised by blowing oxygen into it, or by adding materials which produce an exothermic reaction.

Another important factor in making steel is to reduce the level of impurities, such as the level of sulfur. Desulfurization typically takes place in the ladle, prior to the molten steel being poured into the continuous caster. Lime may be introduced as a desulfurizing agent.

Lances have been used for supplying the oxygen used for reheating the steel, and for adding lime during the desulfurizing step. The lances have been limited to either reheating or desulfurizing, thereby requiring plural lances if reheating and desulfurization are to occur. Furthermore, oxygen injection lances are not suitable for lime addition, because the oxygen flow conduits are not sufficiently large for the required volume of lime.

The desire to reduce sulfur content to ultra-low levels, i.e. 0.002% or less, is growing. The ultra-low sulfur levels may be reached when lime is combined with aluminum oxide resulting from ladle reheating to form a calcium aluminate slag. The two steps involved, however, slow the process, thereby bringing about a need to improve efficiencies.

SUMMARY OF THE INVENTION

A consumable lance, according to the invention, includes a longitudinally extending body having first and second ends. At least a first bore extends through the body and terminates at the second end. The bore is for supplying a first material to a ladle containing molten metal, and into which the body is to be selectively positioned. At least a first tube extends externally along the body and terminates intermediate the ends for supplying a second material to the ladle. The first tube is formed from a composition consumable by the molten metal in the ladle.

A consumable lance has upper and lower portions. The upper portion includes first and second manifolds, wherein the second manifold substantially surrounds the first manifold. The lower portion includes a nozzle extending from the upper portion and has a plurality of internal gas conduits communicating with the first manifold. The lower portion also includes a plurality of tubes secured to the periphery of the nozzle and communicating with the second manifold. While the depicted shape of the second manifold is a circular segment, many other shapes are suitable providing that material is distributed equally to the peripheral tubes.

A consumable lance for a steel making ladle comprises first and second material flow circuits. The first circuit comprises a first manifold and an operably associated apertured nozzle extending therefrom. The second circuit comprises a second manifold disposed about the first nozzle. A plurality of tubes extend along the nozzle and are in flow communication with the second manifold.

A process for reheating and purifying molten steel comprises the steps of providing a consumable lance comprising a nozzle for delivering oxygen into the molten steel below the surface thereof and a manifold from which a plurality of consumable tubes extend therefrom and along the periphery of the nozzle for delivering a purifying agent to the molten steel. A source of oxygen is connected to the nozzle, and a purifying agent is supplied to the manifold. The lance is lowered into the steel, so that the nozzle penetrates the surface and is immersed in the steel to a desired depth. The oxygen is caused to flow to the steel, thereby causing the temperature of the steel to be raised sufficiently thereby with the result that the tubes are consumed and terminate at the surface of the steel. The purifying agent is then communicated to the surface of the steel.

The disclosed invention has the advantage that conventional reheat lances may be modified by the addition of a manifold and external tubes for delivery of the desulfurizing agent. A single lance equipped for both reheat and desulfurization may thus be reconfigured, because separate circuits are used for delivery of oxygen and the desulfurizing agent.

These and other objects and advantages of the invention will be readily apparent in view of the following description and drawings of the above-described invention.

BRIEF DESCRIPTION OF THE DRAWINGS

The above and other objects and advantages and novel features of the present invention will become apparent from the following detailed description of the preferred embodiment of the invention illustrated in the accompanying drawings, wherein.

FIG. *2a* is a fragmentary elevational view of the upper portion of the consumable lance of the present invention.

FIG. *2b* is a fragmentary elevational view of the lower portion of the consumable lance of the present invention.

FIG. 3 is a plan view partially in section of the consumable lance of the present invention.

Figure 1:
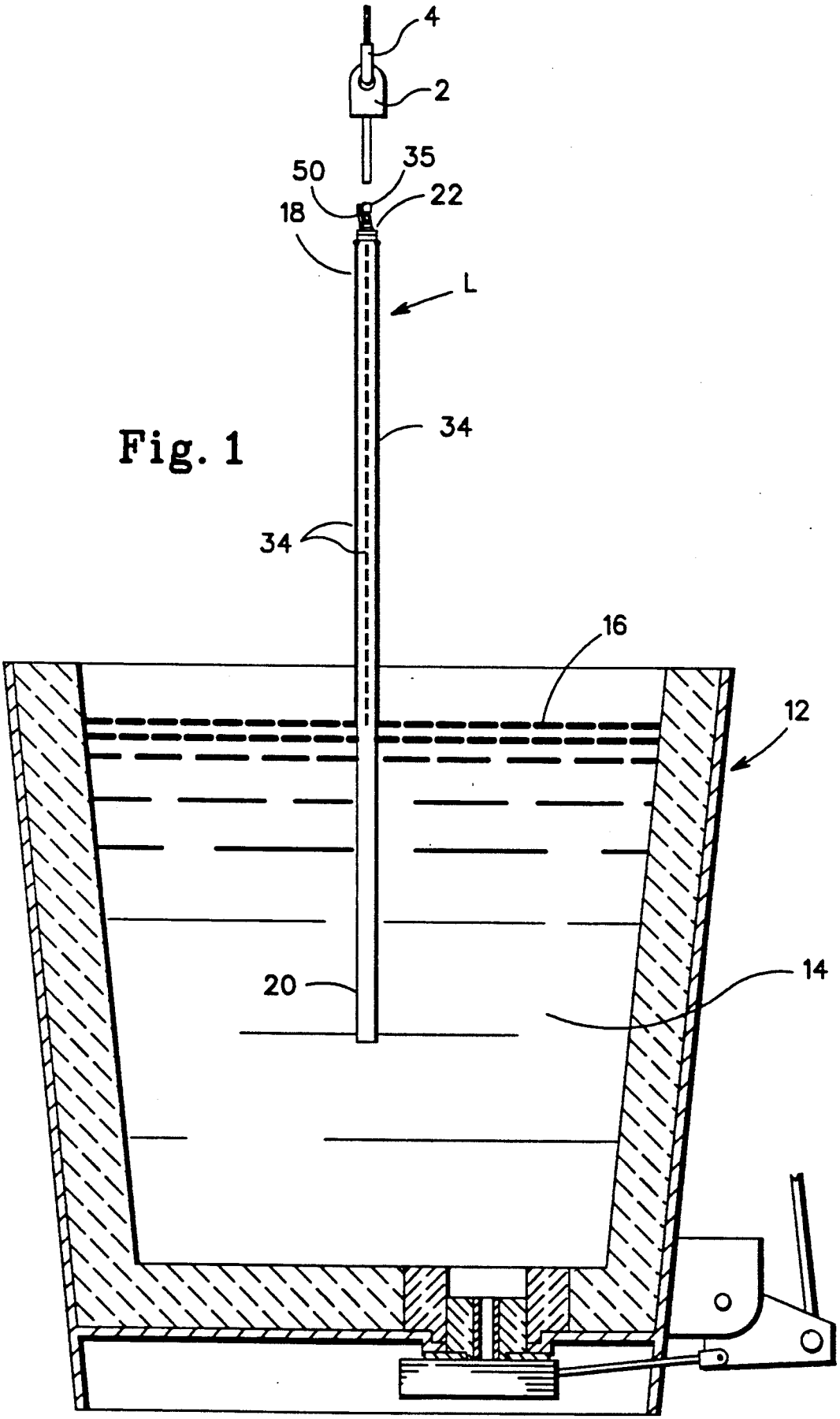
FIG. 1 is a fragmentary cross sectional view of a consumable lance inserted into a steel-making ladle.
Figure 2A:
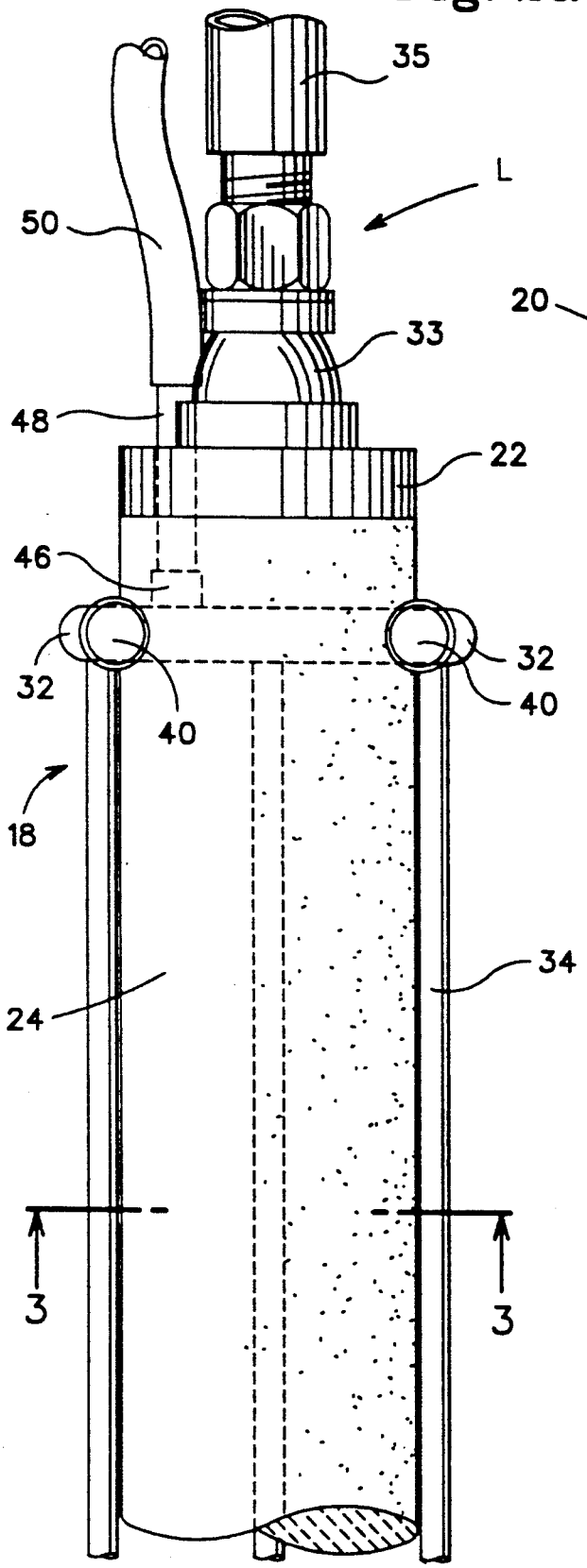
Figure 2B:
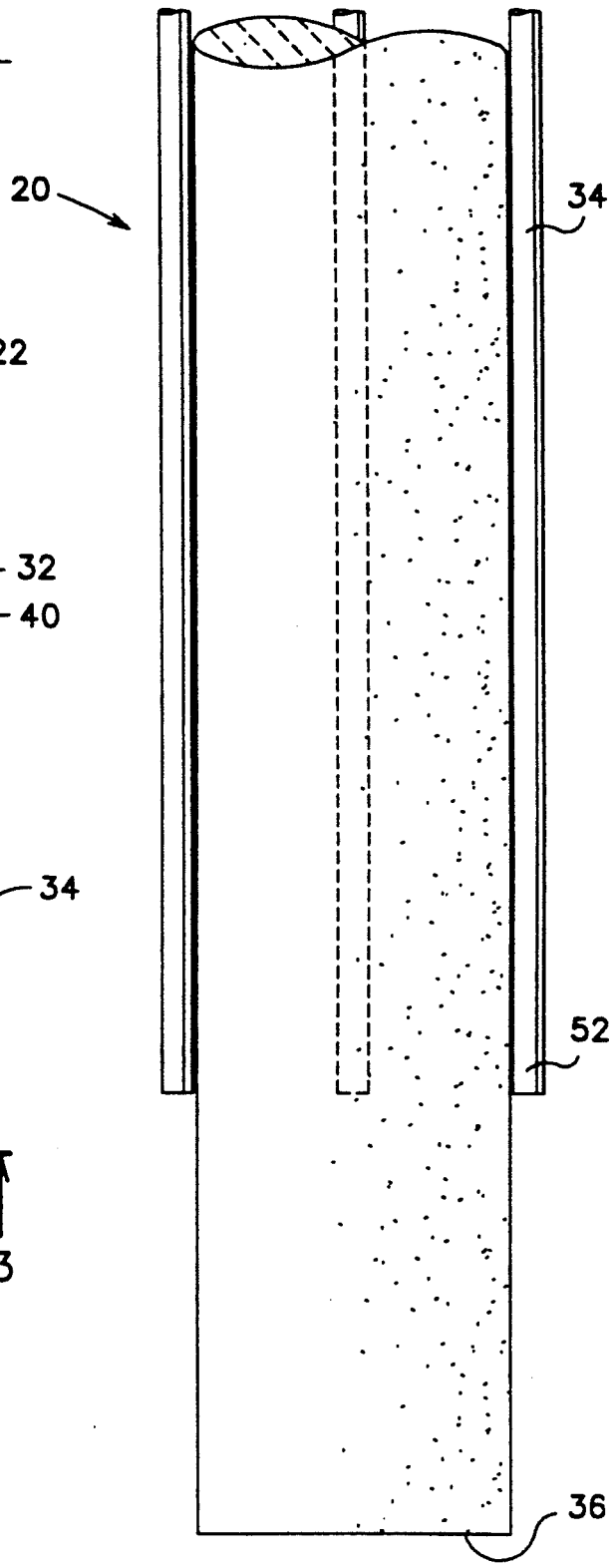

FIG. 4 is a fragmentary elevation view of the area of FIG. 1 within the circle.

DESCRIPTION OF THE INVENTION

As best shown in FIG. 1, a consumable lance L is immersed into ladle 12 containing molten steel 14. Support 2 is operatively secured to lance L and hook 4 of a crane (not shown) for effecting lifting and lowering of lance L. Also not shown are counter weights proximate upper portion 18 which prevent lance L from tilting due to the buoyant forces exerted by molten steel 14. Alternatively, the buoyant forces can be offset by rigidly clamping lance L to a rigid hoist. Lowering of lance L causes slag layer 16 covering molten steel 14 to be penetrated, with the lower end of lance L immersed several feet below slag layer 16. Lance L may be used for supply of oxygen to ladle 12 or, as hereinafter explained, modified to supply oxygen and a purifying agent for the steel 14. Furthermore, while the disclosed invention is explained with reference to desulfurization of steel, those skilled in the art will appreciate that the invention may be used to purify other metals and to remove impurities other than sulfur.

The consumable lance L of the present invention is best shown in FIGS. *2a* and *2b*. Lance L is comprised of an upper portion 18, best shown in FIG. *2a*, and an integral lower portion 20, best shown in FIG. *2b*. Upper portion 18 includes an oxygen conveying manifold 22 connected to lance body 24. Body 24 may be constructed in any of several configurations. A preferred structure for body 24 is found in commonly owned U.S. Pat. No. 4,852,860, the disclosure of which is incorporated herein by reference. The lance design disclosed in said patent maximizes oxygen flow into ladle 12, while minimizing lance consumption and wear, dependent upon the diameter of body 24 and the number of internal tubes 28 through which the oxygen flows.

Body 24, as best shown in FIG. 3, includes a refractory sleeve 26 secured to manifold 22. Steel or copper tubes 28 are encased within refractory 26 and extend longitudinally therealong. Structural support 30 comprises angles 31, and provides rigidity to body 24. Manifold 22 and tubes 28 comprise an internal circuit for delivering oxygen into molten steel 14. Manifold 22 is connected via coupling 33 to a source of oxygen gas (not shown) through supply line 35.

Upper portion 18 also includes manifold 32 secured to manifold 22 and distributing a desulfurizing agent, such as lime or a combination of lime and aluminum, into cylindrical steel down pipes 34. Manifold 32 is external of and surrounds oxygen manifold 22, and may be readily attached thereto when lance L is to be used for purifying steel 14. Otherwise, body 24 may be used solely for oxygen supply. Down pipes 34 are external of body 24 and extend from manifold 32 along the length of body 24. Down pipes 34 are tubular in nature and are secured to the periphery of body 24 by straps or by supports extending from structural support 30. As best shown in FIG. *2b*, down pipes 34 terminate short of nozzle portion 36.

The number of down pipes 34 depends upon the amount of desulfurizing agent to be delivered to the surface of molten steel 14. Generally, however, 2–4 tubes are used and are spaced equiangularly about the circumference of body 24. Because the lime is to be delivered to the slag metal interface 16, then down pipes 34 are formed from steel, unprotected by refractory material, so that pipes 34 melt when immersed within molten steel 14.

Manifold 32 includes tube 38 or other sealed hollow conduit. As best shown in FIG. 3, manifold 32 is preferably circular or a circular segment thereby at least partially surrounding body 24 for distributing a material, such as a desulfurizing agent, equally to tubes 34. Caps 40 are welded to the ends of tube 38 in a gas tight seal 42. Manifold 32 also includes pipe couplings 44 from which tubes 34 depend. Couplings 44 are welded to tube 38 and communicate with the interior thereof. Down pipes 34 are secured to couplings 44 by welding or threaded engagement. In similar fashion, nipple 48 is secured to coupling 46 attached to the opposite side of tube 38. As best shown in FIG. *2a*, down pipes 34 and nipple 48 extend in opposite directions, and therefore couplings 44 and 46 extend in opposite directions. Hose 50 is connected to nipple 48 for conveying desulfurizing agent to manifold 32 from a remote source (not shown).

Lower portion 20, as best shown in FIG. *2b*, includes nozzle 36. Down pipes 34 each have an end 52 which terminates short of nozzle 36. Lower portion 20 of lance L is submerged into molten steel 14 when it is desired to reheat and desulfurize the steel 14 while in the ladle 12. When submerged within steel 14, lower portion 20 is consumed by the molten steel 14. The body 24 and tubes 28 are consumed during the oxygen blow, as disclosed in U.S. Pat. No. 4,852,860, at a rate which varies depending upon body diameter, oxygen flow rate, and the number of internal tubes 28. In order to optimize the effect of the oxygen blow, lance L must be continuously lowered into molten steel 14 at a rate sufficient to maintain nozzle 36 at a desired level below the slag metal interface 16. Tubes 34, on the other hand, are consumed relatively quickly by the reheated steel, because they preferably are unprotected. As best shown in FIG. 4, ends 52 of tubes 34 terminate at the slag metal interface 16 and may be consumed by the temperature of steel 14 up to a level intermediate the thickness of the slag layer 16. Because ends 52 are at interface 16, then the desulfurizing agent is delivered to the resulting reaction zone where stirring is greatest due to the oxygen reaction.

In operation, the consumable lance L is lowered into a ladle of molten steel and simultaneously oxygen and a desulfurizing agent are injected into the molten steel 14 via the two separate flow circuits. The first circuit is the oxygen circuit, including manifold 22 and internal tubes 28, so that oxygen is injected through nozzle 36 at a desired level below the slag metal interface 16. The second circuit is the desulfurizing agent delivery circuit, which includes manifold 32 and down pipes 34.

As described above, nozzle 36 is consumed by steel 14, and therefore lance L must be continuously lowered to maintain it at a desired level below the slag metal interface. Down pipes 34 are steel pipes, typically unprotected by refractory material, which are readily melted back to at least the slag metal interface 16, thereby providing delivery of the desulfurizing agent into the desired zone at or about the slag metal interface 16. Because down pipes 34 are formed from steel, then minimal contamination of steel 14 occurs. The desulfurizing agent is delivered about the periphery of body 24, which is a reaction zone created by the oxygen injection. The molten metal is hottest in the reaction zone and stirring is greatest there so that good disbursement of the desulfurizing agent about the slag metal interface 16 occurs.

Table I presents the results of experiments comparing two methods of simultaneous reheating and desulfurizing molten steel. In Method A, the desulfurizing agents are fed into the molten steel via the oxygen circuit. In method B, the oxygen and desulfurizing agents are delivered via lance L, i.e. oxygen is delivered through the internal tubes 28 several feet below the metal slag interface 16, while the desulfurizing agents are delivered through external tubes 34 to the slag metal interface 16. The desulfurizing agents in Table I were lime and limefluorspar mixtures. Aluminum fuel reacted with oxygen to produce heat and aluminum oxide. The aluminum oxide combined with the lime to form a highly desulfurizing slag.

TABLE I

| | Al, lb/NT | Oxygen, scf/NT | Lime Powder, lb/NT | $O_2$-Lime duration, minutes | Post-stir duration, minutes |
|---|---|---|---|---|---|
| Method A | | | | | |
| 1 | 12.5 | 92 | 29 | 7.3 | — |
| 2 | 14.3 | 125 | 54 | 8.3 | 10 |
| Method B | | | | | |
| 3 | 16.4 | 150 | 72 | 7.0 | 20 |
| 4 | 14.3 | 128 | 58 | 6.0 | 18 |

| | % S | | | Temperature, °F. | | |
|---|---|---|---|---|---|---|
| | Before | Just After | After Post-stir | Before | Just After | After Post-stir |
| Method A | | | | | | |
| 1 | 0.0220 | 0.0070 | — | 2875 | 2945 | — |
| 2 | 0.0035 | 0.0010 | 0.0010 | 2830 | 2955 | 2840 |
| Method B | | | | | | |
| 3 | 0.0070 | 0.0050 | 0.0030 | 2895 | 3035 | 2930 |
| 4 | 0.0030 | 0.0020 | 0.0015 | 2895 | 3030 | 2920 |

The results of Table I show good desulfurization in all cases, as well as gains in temperature.

Desulfurization to levels of 0.002% or less were achieved by use of lance L. Thus, lance L can be used either for oxygen reheating without addition of desulfurization agents, or for oxygen reheating and desulfurization simultaneously.

While this invention has been described as having a preferred design, it is understood that it is capable of further modifications, uses and/or, following the general principle of the invention and including such departures from the present disclosure as come within known or customary practice in the art to which the invention pertains, and as may be applied to the central features hereinbefore set forth, and fall within the scope of the invention of the limits of the appended claims.

I claim:

1. A consumable lance, comprising:

a) a longitudinally extending body having a first end and a second end;

b) at least a first bore extending through said body and terminating at said second end for supplying a first material to a ladle containing molten metal and into which said lance is to be selectively positioned; and c) at least a first tube extending externally along said body and terminating intermediate said ends for supplying a second material to the ladle, said first tube formed from a composition consumable by the molten metal in the ladle.

2. The lance of claim 1, wherein:

a) said tube is formed from a composition substantially corresponding to the composition of the metal in the ladle.

3. The lance of claim 2, wherein:

a) said tube is formed from steel.

4. The lance of claim 1, wherein:

a) there are a plurality of tubes extending along said body, and said tubes are equiangularly disposed thereabout.

5. The lance of claim 4, wherein:

a) each of said tubes is formed from steel.

6. The lance of claim 1, wherein:

a) a manifold is disposed about and operably secured to said body proximate said first end; and b) a plurality of tubes are in flow communication with said manifold and extend along said body for supplying the second material to the ladle.

7. The lance of claim 6, wherein:

a) said tubes are equiangularly spaced about said body.

8. The lance of claim 7, wherein:

a) said bore is connected to a source of oxygen; and b) said manifold is connected to a source of impurity removing material.

9. The lance of claim 1, wherein:

a) said body is comprised of a refractory material consumable by the metal in the ladle; and b) said tube is consumed by the metal at a rate substantially in excess of the rate at which the refractory material is consumed.

10. The lance of claim 9, further comprising:

a) lowering means operably secured to said body for lowering said body into the ladle as a function of the consumption of the refractory material.

11. The lance of claim 6, wherein:

a) a material supply line is operably secured to and extends from said manifold for supplying the second material thereto; and b) said line extends in a direction opposite to the direction in which said tubes extend.

12. The lance of claim 11, wherein:

a) said tubes extend parallel to said bore.

13. The lance of claim 12, wherein:

a) there are at least two of said tubes but no more than four.

14. A consumable lance, comprising:

a) an upper portion having first and second manifolds, said second manifold substantially surrounding said first manifold; and b) a lower portion comprising a nozzle extending from said upper portion and having a plurality of internal gas conduits communicating with said first manifold, and a plurality of tubes extending along the periphery of said nozzle, said tubes communicating with said second manifold.

15. The lance of claim 14, wherein:

a) a refractory material encases said conduits.

16. The lance of claim 14, wherein:

a) said nozzle extends beyond said tubes.

17. The lance of claim 14, wherein:

a) said first manifold is connected to a gas source; and b) said second manifold is connected to a source of desulfurizing agent.

18. A consumable lance for a steel making ladle comprising: first and second material flow circuits, said first circuit comprising a first manifold and an operably associated apertured nozzle extending therefrom and said second circuit comprises a second manifold disposed about said first manifold and a plurality of tubes extending along said nozzle, said tubes in flow communication with said second manifold.

19. The consumable lance of claim 18, wherein:

a) said nozzle extends beyond said tubes; and b) said tubes formed from a material consumable by molten steel, in a ladle and into which the lance is to be placed.

20. The consumable lance of claim 18, wherein:

a) said nozzle comprised of a refractory material; and b) said tubes formed from steel.

21. The consumable lance of claim 20, wherein:

a) said tubes are equiangularly disposed about said nozzle; and b) said tubes extend parallel to the axis of the aperture of said nozzle.

22. A process for reheating and purifying molten steel, comprising the steps of:

a) providing a consumable lance comprising a nozzle for delivering oxygen into the molten steel below the surface thereof and a manifold from which a plurality of consumable tubes extend therefrom and along the periphery of the nozzle for delivering a purifying agent to the molten steel;

b) connecting a source of oxygen to the nozzle;

c) applying a selected purifying agent to the manifold;

d) lowering the lance into a ladle of molten steel so that the nozzle penetrates the surface thereof and is immersed in the steel to a desired depth;

e) causing the oxygen to flow to the steel and thereby causing the temperature of the steel to be raised sufficiently thereby so as to cause the tubes to be consumed thereby and to terminate at the surface of the steel; and f) causing the purifying agent to be communicated to the surface of the steel.

23. The process of claim 22, including the step of:

a) providing to the tubes a purifying agent adapted to desulfurize the steel.

24. The process of claim 22, including the step of:

a) lowering the lance in the steel as the nozzle is consumed, and thereby causing the tubes to be consummed as a result thereof.

* * * * *